US006233936B1

(12) United States Patent
Håkansson

(10) Patent No.: US 6,233,936 B1
(45) Date of Patent: May 22, 2001

(54) INTERNAL COMBUSTION ENGINE WITH EXHAUST WITH GAS RECIRCULATION

(75) Inventor: Nils Olof Håkansson, Stenkullen (SE)

(73) Assignee: AB Volvo, Gothenburg (SE)

( * ) Notice: Subject to any disclaimer, the term of this patent is extended or adjusted under 35 U.S.C. 154(b) by 0 days.

(21) Appl. No.: 09/242,677

(22) PCT Filed: Aug. 19, 1997

(86) PCT No.: PCT/SE97/01361

§ 371 Date: Feb. 22, 1999

§ 102(e) Date: Feb. 22, 1999

(87) PCT Pub. No.: WO98/07976

PCT Pub. Date: Feb. 26, 1998

(30) Foreign Application Priority Data

Aug. 21, 1996 (SE) ..... 9603028

(51) Int. Cl.[7] ..... F02M 25/07

(52) U.S. Cl. ..... 60/605.2; 123/568.11; 123/568.2

(58) Field of Search ..... 123/568.11, 568.12, 123/568.2; 60/605.2

(56) References Cited

U.S. PATENT DOCUMENTS

| | | | | |
|---|---|---|---|---|
| 5,333,456 | * | 8/1994 | Bollinger | 60/605.2 |
| 5,601,068 | * | 2/1997 | Nozaki | 123/568.12 |
| 5,682,746 | * | 11/1997 | von Hoerner | 60/605.2 |
| 5,762,051 | * | 6/1998 | Okamoto | 123/568.2 |
| 5,937,834 | * | 8/1999 | Oto | 123/568.2 |

FOREIGN PATENT DOCUMENTS

| | | | | |
|---|---|---|---|---|
| 0 585 105 | | 3/1994 | (EP) . | |
| 0 596 855 | | 5/1994 | (EP) . | |
| 1-17815 | * | 9/1979 | (JP) | 60/605.2 |
| 6-0648 | * | 5/1980 | (JP) | 60/605.2 |
| 57-210157 | | 12/1982 | (JP) . | |
| 1-177446 | | 7/1989 | (JP) . | |

* cited by examiner

*Primary Examiner*—Willis R. Wolfe
(74) *Attorney, Agent, or Firm*—Young & Thompson

(57) ABSTRACT

Supercharged internal combustion engine with exhaust recirculation, in which the exhaust manifold of the engine communicates, via non-return valves and an exhaust conduit, with the inlet manifold of the engine. The non-return valves are arranged to only open when the exhaust pressure in the exhaust manifold is higher than the charged air pressure.

11 Claims, 3 Drawing Sheets

INTERNAL COMBUSTION ENGINE WITH EXHAUST WITH GAS RECIRCULATION

BACKGROUND OF THE INVENTION

The present invention relates to an internal combustion engine, comprising an inlet manifold and an exhaust manifold, respectively, opening into inlet ducts and exhaust ducts, respectively, to the engine cylinders, a charging unit, the pressure side of which is connected to an inlet air conduit opening into the inlet manifold; and a conduit for recirculation of exhaust from the exhaust side of the engine to its inlet side.

In supercharged internal combustion engines, e.g. turbo engines, the charged pressure of the intake air in the intake manifold is often higher than the mean pressure of the exhaust in the exhaust manifold, which means that conventional shutter and valve devices used in suction engines cannot be used in supercharged engines to transfer exhaust to the pressure side of the compressor. It is known to achieve this to use some type of pressure increaser on the exhaust side, e.g. constriction in the form of a turbo unit with variable geometry, or some form of pump device.

If the principle of pressure increase is used, this means that the engine will work against a pressure with its entire exhaust flow to return only a fraction of the flow, approximately 10%, to the inlet side, which results in an undesirable loss of efficiency. The principle with the pump, in addition to the extra cost and complexity, involves a parasitic loss corresponding to the rise in pressure of about 10% of the exhaust flow divided by the efficiency of the pump, i.e. a total of approximately 20% of the exhaust flow times the rise in pressure.

SUMMARY OF THE INVENTION

The purpose of the present invention is to achieve an internal combustion engine of the type described by way of introduction, in which exhaust can be returned to the inlet side without any loss of efficiency and with much simpler and less expensive means than a pump device.

This is achieved according to the invention by virtue of the fact that the recirculation conduit communicates with valve means and that valve control means are arranged, during such operating conditions where the exhaust is to be recirculated, to only permit the valve means to open when the exhaust pressure in the manifold is higher than the air pressure on the pressure side of the charging unit.

The invention is based on the insight that the pressure during the pressure pulsations in the exhaust manifold has pressure peaks, which exceed the charge pressure in the inlet manifold, and use valve means which open at these pressure peaks but are kept closed therebetween to prevent inlet air from flowing to the exhaust side.

In its simplest form, the valve and control means can be non-return valves.

BRIEF DESCRIPTION OF THE DRAWINGS

The invention will be described in more detail below with reference to examples shown in the accompanying drawings, where.

DESCRIPTION OF THE PREFERRED EMBODIMENTS

Figure 1:
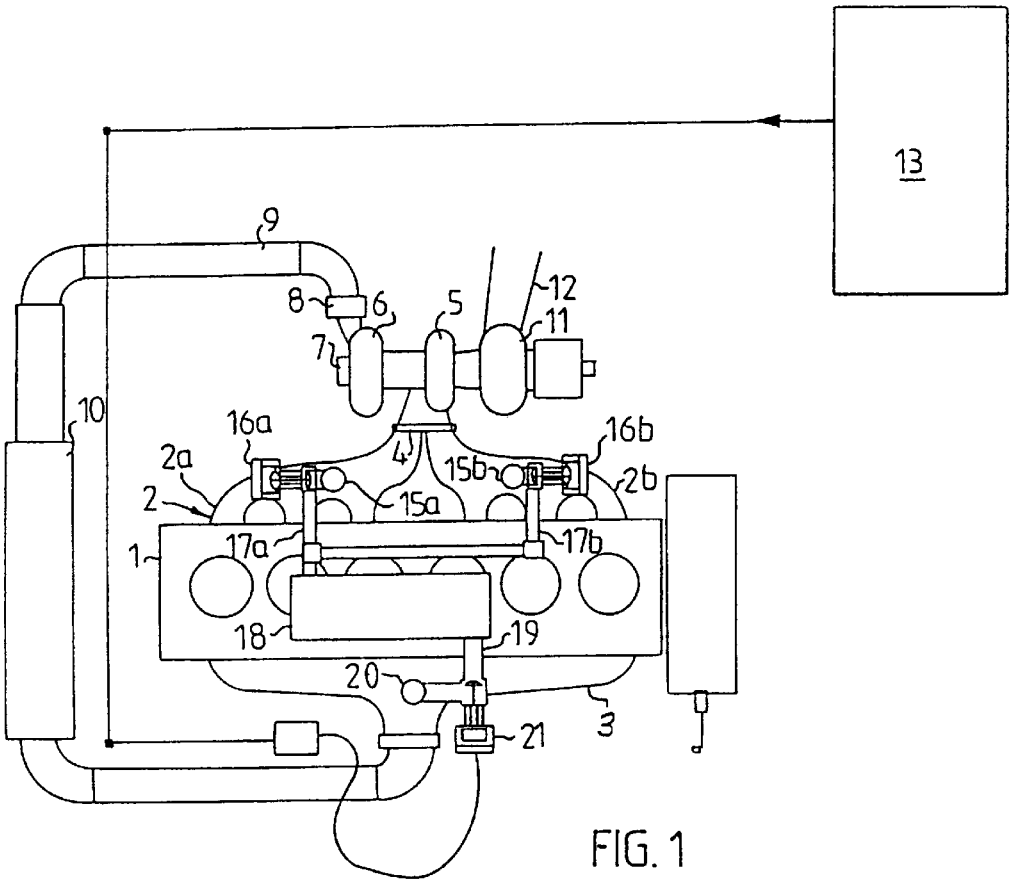
FIG. 1 shows schematically a first embodiment of an internal combustion engine with valve and control means according to the invention.
Figure 4:
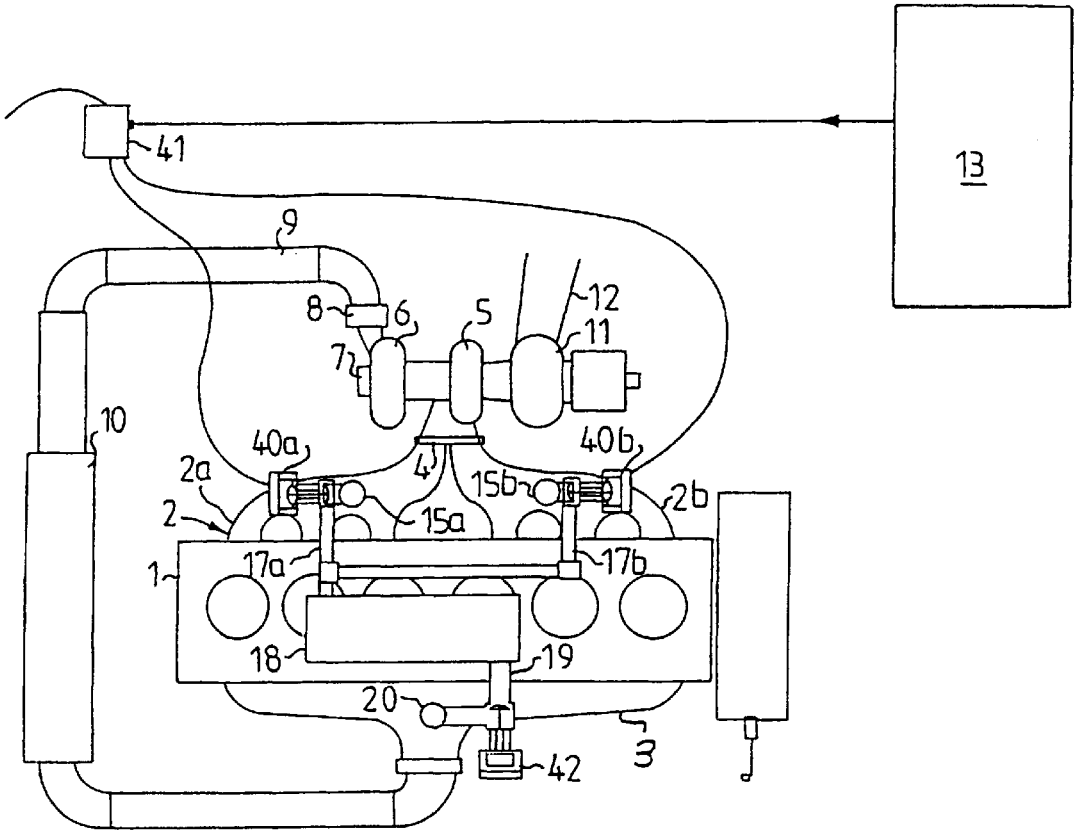
FIG. 4 shows a view corresponding to FIG. 1 of a second embodiment.

In FIGS. 1 and 4, 1 designates a six-cylinder diesel engine with an exhaust manifold 2 and an inlet manifold 3. The exhaust manifold is divided into two branch portions 2*a* and 2*b*, each with three branches, which communicate with the exhaust ducts of the engine. The branch portions 2*a*,2*b* open into the inlet 4 of an exhaust turbine 5, to which a compressor 6 is drivably coupled. The compressor 6 has an inlet 7 for intake air and an outlet 8 coupled to an inlet air conduit 9, which via a charged air cooler 10 leads the inlet air to the inlet manifold 3. The exhaust turbine 5 is joined via an exhaust pressure regulator 11 to an exhaust pipe 12.

13 generally designates a control unit which is known per se and which is preferably microcomputer controlling different engine and vehicle functions depending on engine data fed into the control unit, such as charge pressure, rpm and air temperature as well as vehicle data such as ABS on/off, vehicle speed, accelerator position etc.

Each branch portion 2*a* and 2*b* is joined to a short pipe 15*a*, 15*b*, which communicates with the inlet to a non-return valve 16*a*, 16*b* (FIG. 1), the outlet of which is joined to conduits 17*a*,17*b*, which come together and open into a cooler 18, from which a conduit 19 leads to an inlet 20 to the inlet manifold 3 of the engine. In the conduit 19 there is arranged a regulator valve 21 controlled by a control unit 13. The regulator valve 21 regulates the flow from the cooler 18 to the inlet manifold 3.

Figure 2:
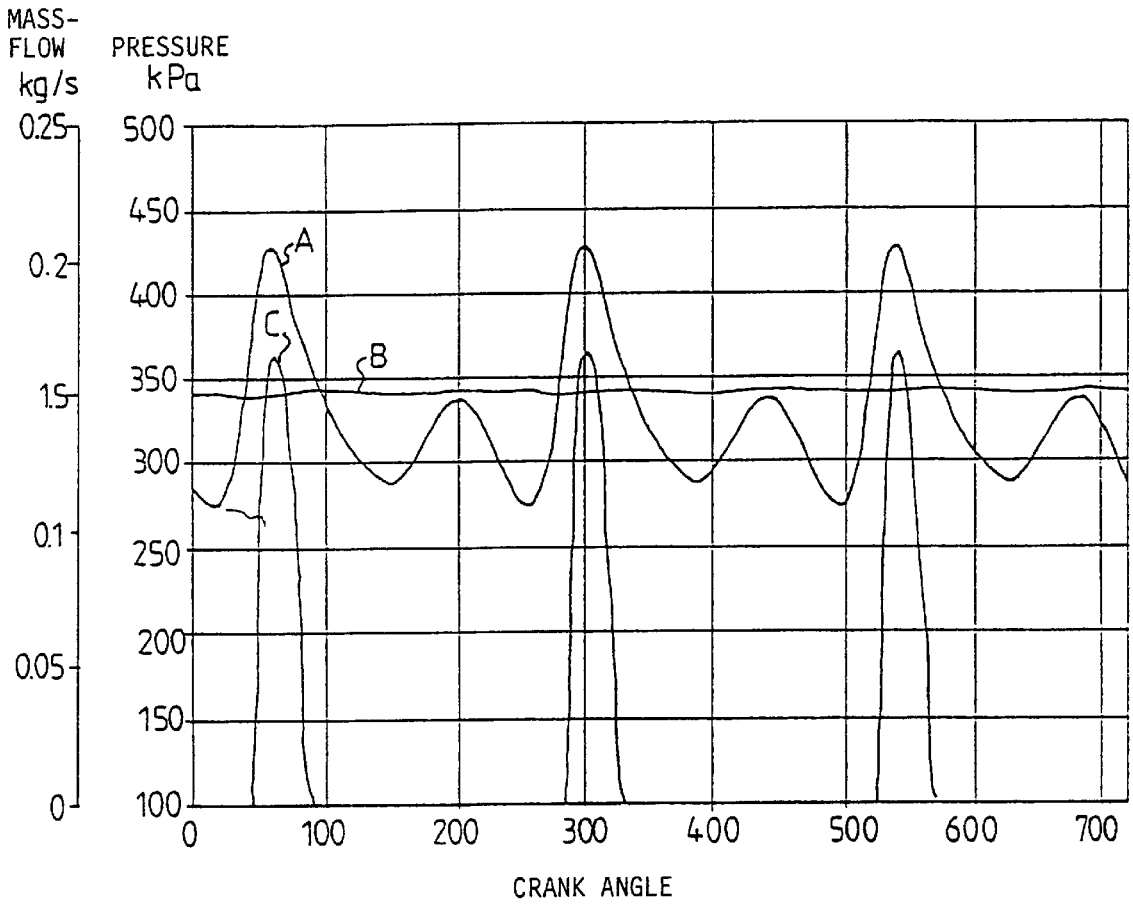
FIG. 2 shows a diagram illustrating exhaust and charge pressure as well as mass flow of returned exhaust.

When the operating stage of the engine is such that exhaust can be recirculated to the inlet manifold, the control unit 13 sends signals to the regulator valve 21 to open the communication between the cooler 18 and the inlet manifold 3. As soon as the pressure in the exhaust manifold 2 of the exhaust pulse exceeds the charged air pressure, i.e. the pressure in the conduit 17*a*,17*b*, the non-return valve 16*a*, 16*b* open and exhaust can flow to the inlet side of the engine. In the example shown in FIG. 1 with one non-return valve 16*a*,16*b* for each group of three cylinders, the non-return valves open three times during two rotations of the crankshaft, as illustrated in the diagram in FIG. 2, where the curve A represents the exhaust pressure in each branch portion 2*a*,2*b*; the curve B represents the charged air pressure in the inlet manifold 3 and the curve C represents the massflow of returned exhaust.

Figure 3:
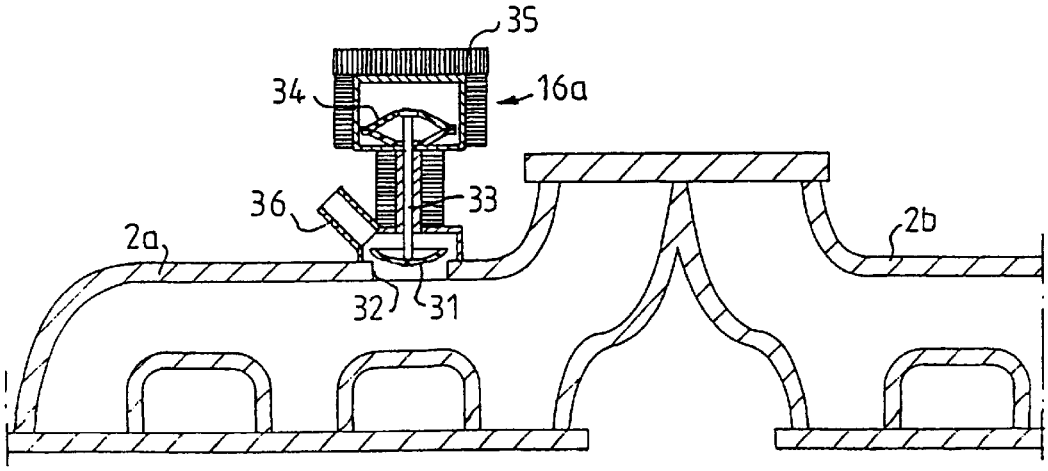
FIG. 3 shows a section through a portion of an exhaust manifold with a valve means.

FIG. 3 shows a non-return valve 16*a* on a larger scale and arranged so that its valve disc 31 in the closed position of the valve seals against the edge of an inlet 32 which is formed by an opening directly into the manifold wall. The manifold disc 31 is joined to a valve spindle 33, which in turn is loaded by a spring 34, which biases the disc 31 towards its closed position. By mounting the valve at the shortest possible distance from the cylinders of the engine, the minimum possible damping of the exhaust pulses is obtained. In order to protect the valves from the high temperature of the exhaust manifold, they are provided with cooling fins 35. The valve 16*a* has a pipe stub 36 to which a conduit 17*a* is to be connected.

The arrangement in FIG. 4 differs from that shown in FIG. 1 in that the non-return valve 16*a*, 16*b* are replaced by a pair of electromagnetically operated valves 40*a*,40*b*, which are controlled, via an amplifier 41, by the control unit 13. The valves and their closing will be somewhat more complicated than when using the non-return valves 16*a*,16*b*, controlled by the pressure difference between the charge pressure and the exhaust pressure, but on the other hand, the controlling can be made more exact. FIG. 4 shows as well an extra regulator valve 42, by means of which the amount of recirculated exhaust is controlled, if the valves 40*a*,40*b* are of the type which can only switch between open and closed position. If the valves 40*a*,40*b* are regulator valves with a variable degree of opening, the regulator valve 42 can be eliminated. As an alternative to non-return valves or electromagnetically controlled valves, valves hydraulically controlled by a cam shaft system can be used.

What is claimed is:

1. Internal combustion engine, comprising an inlet manifold (3) and an exhaust manifold (2), respectively, opening into inlet ducts and exhaust ducts, respectively, to the engine cylinders, a charging unit (6), the pressure side (8) of which is connected to an inlet air conduit (9) opening into the inlet manifold; and a conduit (17*a*, 17*b*, 19) for recirculation of exhaust from the exhaust side of the engine to its inlet side, characterized in that the recirculation conduit (17*a*, 17*b*, 19) communicates with valve means (16*a, b*; 40*a, b*) which are connected directly to the exhaust manifold and that valve control means (13) are arranged, during such operating conditions where the exhaust is to be recirculated, to only Permit the valve means to open when the exhaust pressure in the manifold (2) is higher than the air pressure on the pressure side of the charging unit (6), and characterized in that the exhaust manifold (2) is divided into at least two branch portions (2*a, b*) which open into a common exhaust pipe (4), and that the valve means comprise one valve (16*a, b*; 40*a, b*) in each branch portion.

2. In an internal combustion engine having an inlet side with an inlet manifold opening to an inlet duct, an exhaust side with an exhaust manifold opening to an exhaust duct, a charging unit having a pressure side that communicates with the inlet duct, and a recirculation conduit that recirculates exhaust from the exhaust side to the inlet side, the improvement wherein the recirculation conduit communicates with a valve that opens directly into the exhaust manifold only when a pressure in the exhaust manifold exceeds a pressure in the pressure side of the charging unit.

3. Internal combustion engine, comprising an inlet manifold (3) and an exhaust manifold (2), respectively, opening into inlet ducts and exhaust ducts, respectively, to the engine cylinders, a charging unit (6), the pressure side (8) of which is connected to an inlet air conduit (9) opening into the inlet manifold; and a conduit (17*a*, 17*b*, 19) for recirculation of exhaust from the exhaust side of the engine to its inlet side, characterized in that the recirculation conduit (17*a*, 17*b*, 19) communicates with valve means (16*a, b*; 40*a, b*) which are connected directly to the exhaust manifold and that valve control means (13) are arranged, during such operating conditions where the exhaust is to be recirculated, to only permit the value means to open when the exhaust pressure in the manifold (2) is higher than the air pressure on the pressure side of the charging unit (6).

4. Internal combustion engine according to claim 3, characterized in that the recirculation conduit (17*a, b*, 19) communicates with the inlet side via a cooler (18).

5. Internal combustion engine according to claim 4, characterized in that the exhaust manifold (2) is divided into at least two branch portions (2*a, b*) which open into a common exhaust pipe (4), and that the valve means comprise one valve (16*a, b*; 40*a, b*) in each branch portion.

6. Internal combustion engine according to claim 3, characterized in that said valve means are formed of at least one non-return valve (16*a*, 16*b*) which is arranged to open for exhaust recirculation when the exhaust pressure in the manifold (2) is higher than the inlet air pressure.

7. Internal combustion engine according to claim 6, characterized in that the recirculation conduit (17*a, b*, 19) communicates with t he inlet side via a cooler (18).

8. Internal combustion engine according to claim 6, characterized in that the exhaust manifold (2) is divided into at least two branch portions (2*a, b*) which open into a common exhaust pipe (4), and that the valve means comprise one valve (16*a, b*; 40*a, b*) in each branch portion.

9. Internal combustion engine according to claim 3, characterized in that said valve means are formed of at least one solenoid valve (40*a*, 40*b*), which is controlled by a control unit (13), which is arranged, depending on engine data fed to the control unit, to open the valve when the exhaust pressure in the manifold (2) is higher than the inlet air pressure.

10. Internal combustion engine according to claim 9, characterized in that the recirculation conduit (17*a, b*, 19) communicates with the inlet side via a cooler (18).

11. Internal combustion engine according to claim 9, characterized in that the exhaust manifold (2) is divided into at least two branch portions (2*a, b*) which open into a common exhaust pipe (4), and that the valve means comprise one valve (16*a, b*; 40*a, b*) in each branch portion.

* * * * *